US011058211B2

(12) United States Patent
Willows et al.

(10) Patent No.: US 11,058,211 B2
(45) Date of Patent: Jul. 13, 2021

(54) COMPRESSION SLEEVE AND FLEXIBLE BOTTLE

(71) Applicant: Amphipod, Inc., Seattle, WA (US)

(72) Inventors: Keith Willows, Seattle, WA (US); June Angus, Seattle, WA (US); Antonio Del Rosario, Bellevue, WA (US)

(73) Assignee: Amphipod, Inc., Seattle, WA (US)

( * ) Notice: Subject to any disclaimer, the term of this patent is extended or adjusted under 35 U.S.C. 154(b) by 19 days.

(21) Appl. No.: 16/773,349

(22) Filed: Jan. 27, 2020

(65) Prior Publication Data

US 2020/0237082 A1 Jul. 30, 2020

Related U.S. Application Data

(60) Provisional application No. 62/918,470, filed on Jan. 30, 2019.

(51) Int. Cl.

| | |
|---|---|
| ***A45F 3/20*** | (2006.01) |
| ***A45F 5/10*** | (2006.01) |
| *A45F 5/02* | (2006.01) |

(52) U.S. Cl.

CPC ..... *A45F 3/20* (2013.01); *A45F 5/10* (2013.01); *A45F 5/02* (2013.01); *A45F 2005/1013* (2013.01); *A45F 2200/0583* (2013.01)

(58) Field of Classification Search

CPC ..... A45F 2200/0583; A45F 3/16; A45F 3/20; A45F 2003/166; B65D 21/086; B65D 1/32; B65D 1/323; B65D 1/326; A45C 7/0063; A45C 7/0068

USPC ..... 224/148.4–148.6

See application file for complete search history.

(56) References Cited

U.S. PATENT DOCUMENTS

| | | | | |
|---|---|---|---|---|
| 5,913,448 | A * | 6/1999 | Mann | B65D 21/086 220/666 |
| 6,029,847 | A * | 2/2000 | Mahoney, Jr. | A45C 11/20 220/592.24 |
| 7,090,075 | B1 * | 8/2006 | Rocha | A63B 55/00 206/315.2 |
| 2007/0257034 | A1 * | 11/2007 | Sabounjian | B65D 21/086 220/9.2 |
| 2010/0308086 | A1 * | 12/2010 | Chapuis | A45F 3/04 224/148.2 |
| 2012/0187160 | A1 * | 7/2012 | Wolf | A45C 11/00 224/148.4 |

* cited by examiner

*Primary Examiner* — Adam J Waggenspack

(74) *Attorney, Agent, or Firm* — Lowe Graham Jones PLLC

(57) ABSTRACT

A compression sleeve and flexible bottle combine to serve as a fluid carrier such as for water or sports beverages. The flexible bottle has an interior volume for holding the fluid, the flexible bottle being readily collapsible to conform the interior volume of the flexible bottle to a volume of the fluid held within the flexible bottle, with a compression sleeve surrounding the flexible bottle. A pull-cord is attached to the compression sleeve and is moveable from a first position in which the pull-cord is retracted to a second position in which the pull-cord is extended, in which moving the pull-cord from the first position to the second position causes a contraction of the compression sleeve and a corresponding contraction of the flexible bottle.

24 Claims, 18 Drawing Sheets

COMPRESSION SLEEVE AND FLEXIBLE BOTTLE

PRIORITY CLAIM

This application claims the benefit of U.S. provisional application No. 62/918,470, filed Jan. 30, 2019, the contents of which are incorporated by reference.

FIELD OF THE INVENTION

This invention relates generally to sleeves for use with water bottles, flasks, or other liquid beverage containers.

BACKGROUND AND SUMMARY OF THE INVENTION

The following discloses a compression sleeve for a flexible bottle with hand-affixing features and a process for making the compression sleeve for a flexible bottle wherein the sleeve and associated hand affixing features are manufactured to firmly and reliably attach to a collapsible bottle or other fluid container to provide a comfortable interface of a user's hand to the bottle while the user is running, walking, exercising, etc. Further, the following discloses a preferred flexible collapsible bottle for use with the compression sleeve.

The compression sleeve preferably provides a number of features, including insulation and the ability of the user to adjust the compression of held fluids, in an easily carried and portable container. The compression sleeve allows ready-access to fluids as desired and provides a number of benefits such as: allowing no-bounce/no slosh carrying of fluids, providing a simple user-enabled fluid delivery that allows the user to adjust the delivery flow and stream of fluids to the mouth, as well as allowing the user to reduce the volume of the bottle as fluid is consumed.

The above mentioned features and benefits are valuable for engaging in sports like running, walking, and many outdoor activities or the like.

A preferred compression sleeve and flexible bottle combine to serve as a fluid carrier such as for water or sports beverages. In one example, a flexible bottle has an interior volume for holding the fluid, the flexible bottle being readily collapsible to conform the interior volume of the flexible bottle to a volume of the fluid held within the flexible bottle. A compression sleeve surrounds the flexible bottle. Preferably, a pull-cord is attached to the compression sleeve at a first location along the pull-cord and having a second location along the pull-cord extending from the compressing sleeve, the pull-cord being moveable from a first position in which the pull-cord is retracted to a second position in which the pull-cord is extended, wherein moving the pull-cord from the first position to the second position causes a contraction of the compression sleeve and a corresponding contraction of the flexible bottle.

In some versions, the compression sleeve further comprises a top end and a bottom end, the first location of the pull-cord being attached to the bottom end of the compression sleeve and the second location of the pull-cord extending from the compression sleeve at a location relatively closer to the top end.

In some versions of the invention, the flexible bottle further comprises a spout, the spout extending from the top end of the compression sleeve.

In some examples, the pull-cord is further attached to the bottom end of the compression sleeve at a third location, the second location of the pull-cord being positioned between the first location and the third location.

Some preferred versions include a friction lock, the friction lock engaging the pull-cord to retain the pull-cord in a plurality of positions between the first position and the second position.

In some versions, the compression sleeve includes a bottom pull-strap, the bottom pull-strap being connected to the first location of the pull-cord, whereby pulling on the pull-strap in a first direction while holding the top end of the compression sleeve in a fixed position (or pulling it in the opposite direction) causes the pull-cord to move toward the first position.

Optionally, a first finger/thumb loop is attached at the top end of the compression sleeve. A second finger/thumb loop may be attached at the top end of the compression sleeve. In some versions, a loop strap forming a central loop is located between the first finger/thumb loop and the second finger/thumb loop.

In some examples, a pull-cord is further attached to the bottom end of the compression sleeve at a third location, the second location of the pull-cord being positioned between the first location and the third location, the compression sleeve further comprising a base cup, the base cup being positioned at the bottom end of the compression sleeve and having a first side attached to the first location of the pull-cord and a second side attached to the third location of the pull-cord.

In some examples, a collar junction is attached to the top end of the compression sleeve, the collar junction being arranged such that a portion of the pull-cord and a portion of the flexible bottle extend through the collar junction.

A friction lock may be attached to the collar junction, the friction lock engaging the pull-cord to retain the pull-cord in a plurality of positions between the first position and the second position.

In some versions, the pull-cord is trained within a first cord tunnel extending along the compression sleeve from a top end of the compression sleeve to a bottom end of the compression sleeve. The pull-cord may further be attached to the bottom end of the compression sleeve at a third location, the second location of the pull-cord being positioned between the first location and the third location. A first portion of the pull-cord located between the first location and the second location may be trained within a first cord tunnel extending along the compression sleeve from a top end of the compression sleeve to a bottom end of the compression sleeve. A second portion of the pull-cord located between the third location and the second location may be trained within a second cord tunnel extending along the compression sleeve from a top end of the compression sleeve to a bottom end of the compression sleeve.

Most preferably, the compression sleeve comprises an elastomeric layer having a first end and a second end joined together to define a seam, and a central stitch securing the first end to the second end along the seam.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
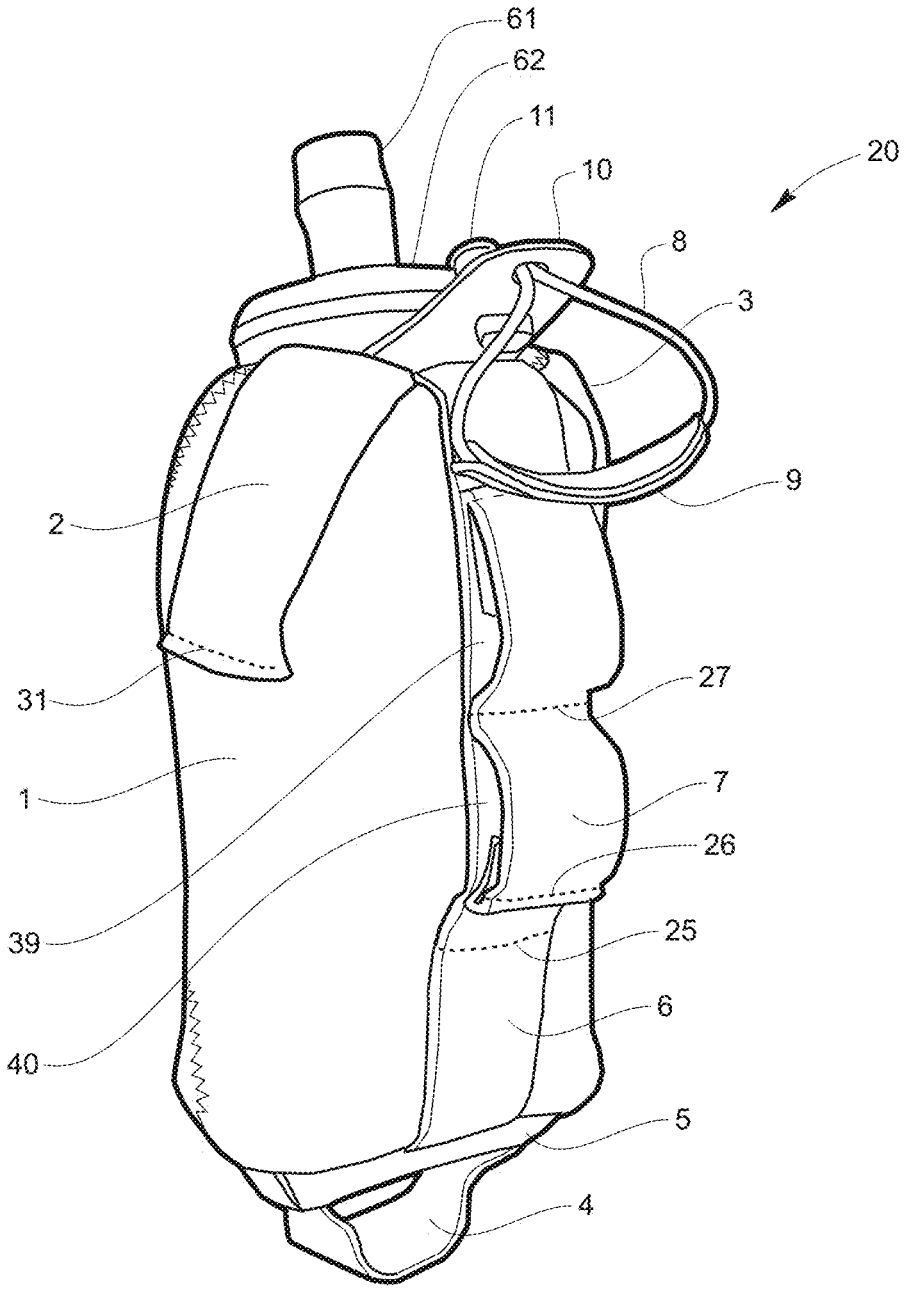
FIG. 1 is a rear three-quarter perspective view of a preferred compression sleeve, shown attached to a flexible bottle.

With reference to the figures, initially including FIG. 1, a preferred compression sleeve 20 includes a main portion 1. Most preferably, the main portion 1 is formed from an elastomeric main layer such as neoprene or other sheet material of appropriate thickness, and is preferably die-cut in a single piece in dimensions allowing it to be joined and formed as described further below. Further, the neoprene or other elastomeric sheet material forming the main layer for the sleeve is preferably laminated on one or both faces with other sheet material to provide one or more surface layers (which may include an interior surface layer and an exterior surface layer), preferably from fabric such as tricot nylon, spandex, lycra or other fabric which preferably has a stretch characteristic. The thickness for the main layer of sheet material can range from 1 mm or less, or to 4 mm or more, depending on the desired insulation qualities, cushioning or other aspects. A thickness of 1.5 mm for the main layer is particularly preferred.

The main portion 1 of the sleeve (which may also be called the sleeve body) may also be produced from other flexible sheet materials which allow for printing or other forms of layering, such as with flexible plastics. To the extent the choice of sheet material allows for it, in some versions the main layer may not be laminated, and optionally it may be printed, stickered/decaled, silk-screened, coated, painted, or otherwise clad with a thin layer of material that adds visual appeal strength, durability, reflectivity or other useful functions.

While the sleeve body is preferably cut-out from sheet materials by a die-cutting process, it may alternatively be produced through any of a number of different manufacturing processes such as injection molding, pressure forming or others, such that the desired shape, geometry, structure, and durability are created. In some cases it may be desirable to manufacture the main body by casting, injection molding or otherwise molding or forming it.

The compression sleeve as described further below may offer many benefits over existing items on the market. One advantage is its ease of manufacturing. The preferred sleeve can be constructed using inexpensive and easily obtained materials, assembled using conventional manufacturing equipment, and produced relatively easily and inexpensively. It may also be formed from light and comfortable materials which are readily available, giving an aesthetically pleasing highly functional, versatile solution for its desired purpose.

With particular reference to figure, a preferred compression sleeve 20 is shown with a sleeve body 1, finger/thumb loops 2 and 3, a bottom pull strap 4, a base cup 5, a hand strap 6, a loop strap 7, a pull cord 8 with a pull grip 9, a collar junction 10, a friction lock 11, and a flask 60 which is mostly hidden in FIG. 1 except for a spout 61 and a cap 62. Other components visible in FIG. 11 and FIG. 13 include edge binding 12 and cord tunnel cover strapping 21 and 22.

Figure 22:
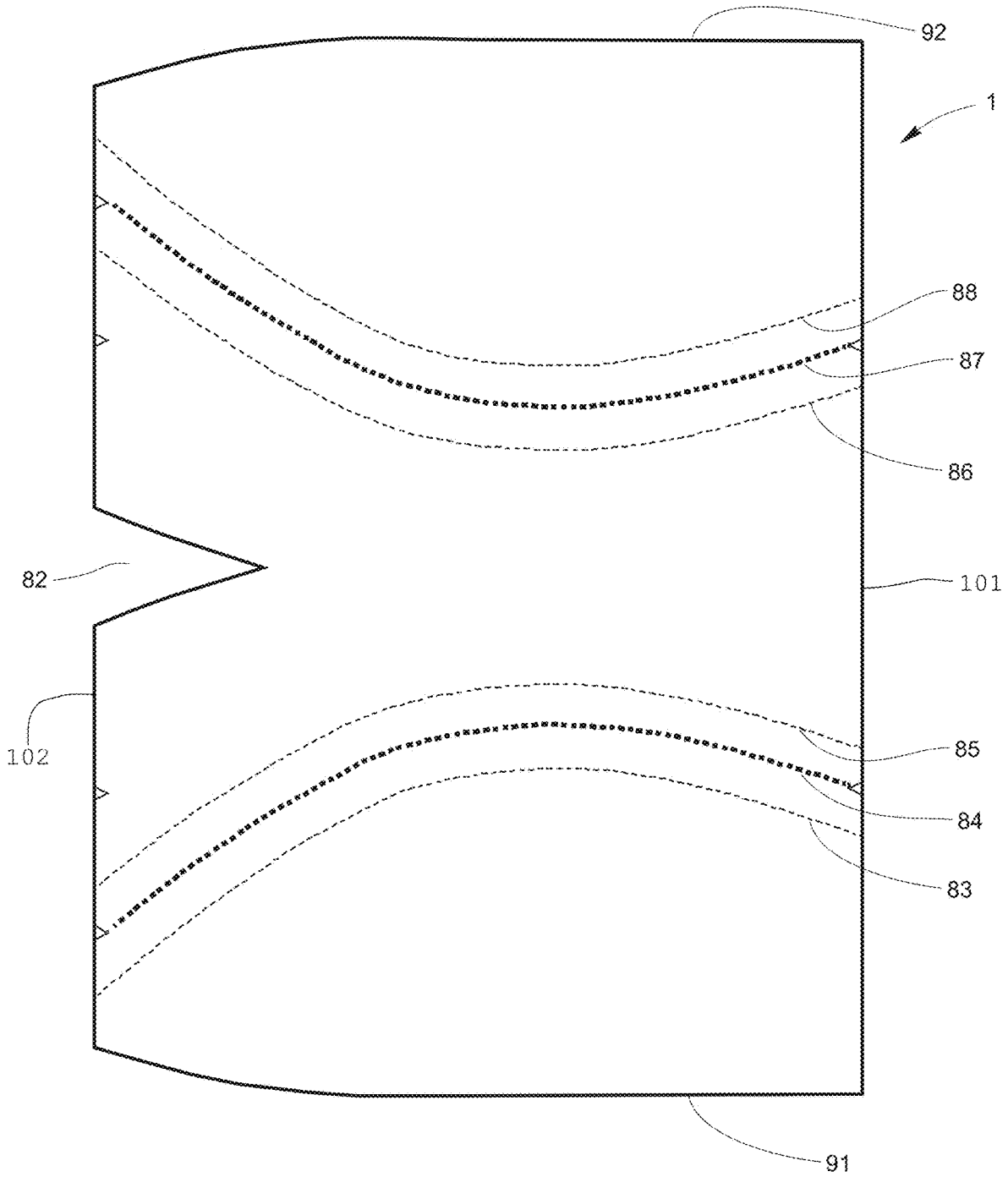
FIG. 22 is a plan view of a preferred sleeve body before it has been assembled.

The sleeve body 1 is preferably formed from sheet stock as described above, in a die-cutting process in a perimeter cut shape shown in FIG. 22. FIG. 22 not only shows a preferred die-cut perimeter shape for sleeve body 1, with dart 82 but also shows preferred cord tunnel placement, including a first cord tunnel with a defined cord tunnel path 84 and a second cord tunnel with a second cord tunnel path 87. In each case as shown, the first and second cord tunnels follow a curved or arcuate path, with the first and second cord tunnels curving in directions away from one another.

The widths of the first and second cord tunnels are defined by broken lines 83, 85 and 86, 88, wherein cord paths 84 and 87 are defined by the cord path boundaries indicated by the broken lines 83, 85 and 86, 88. When the sleeve body is assembled as described, a length of strapping material 22 (see, e.g., FIG. 13) such as a flexible ribbon, webbing, edging strip material or other tunnel cover strapping is attached to the surface of the die-cut sheet stock sleeve body to form the cord tunnel between the sleeve body material and the strapping material. A first swatch of strapping material is provided with an approximate width to span the first cord tunnel width distance as indicated by the cord tunnel boundaries 83 and 85 and swatch of strapping material 21 is provided to span the width between cord tunnel boundaries 86 and 88. The first and second swatches also have lengths such that they define a tunnel substantially from the top 101 of sleeve 1 to the bottom 102 of sleeve 1 (see FIG. 22).

The tunnel cover strapping 21 and 22 are placed and curved along this defined path and preferably sewn in place such that a long tunnel is defined by stitches 14, 15 (see FIG. 2), 16 and 17 (see FIG. 3) on paths 88, 86, 85 and 83 defining cord paths 87 and 84 denoted in broken lines on FIG. 22.

Figure 4:
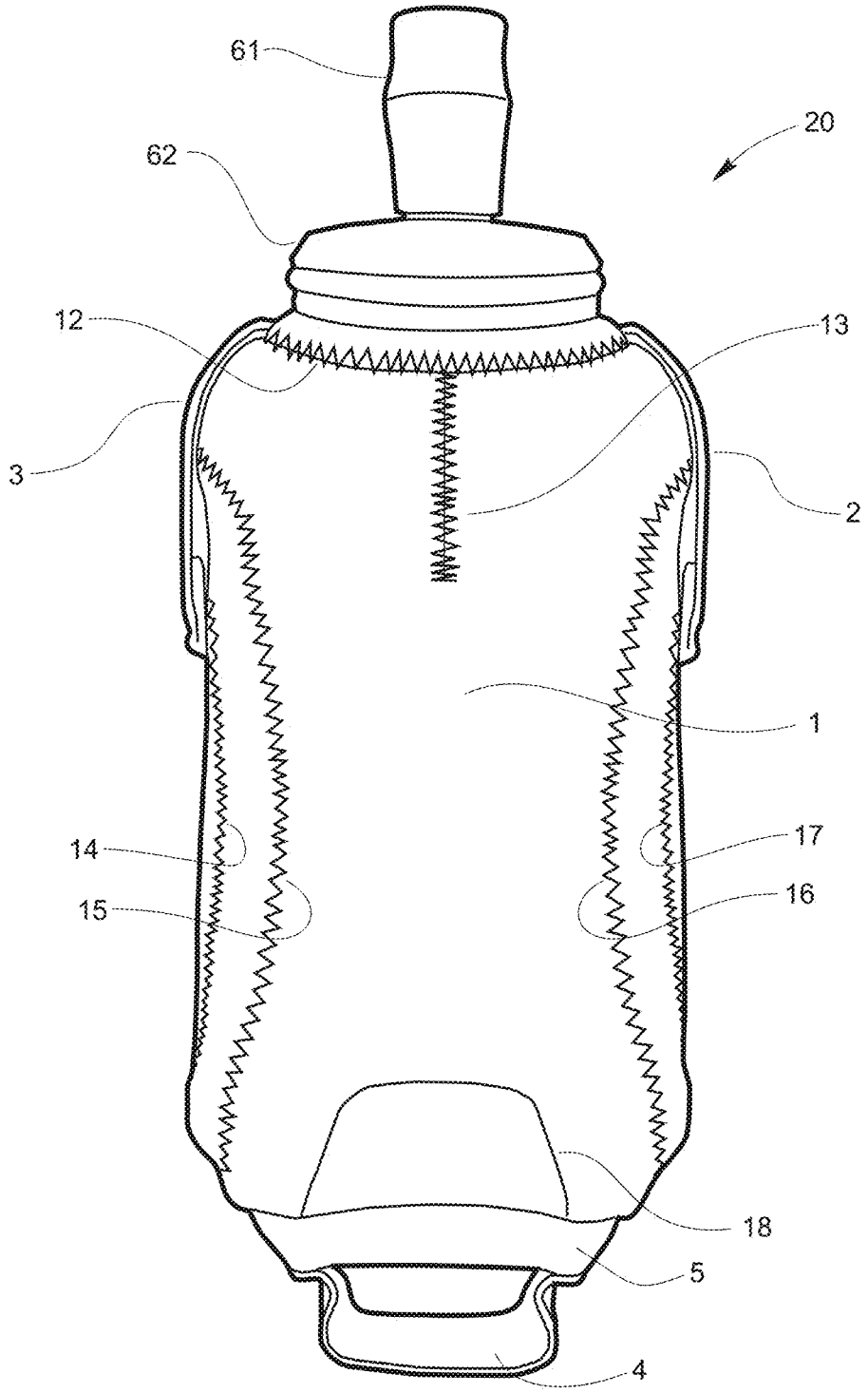
FIG. 4 is a front view of a preferred compression sleeve attached to a bottle.

The edges of dart 82 are joined and sewn together with stitch 13 as shown in FIG. 4, whereby this "V"-shaped dart 82 in the flat die-cut part shown in FIG. 22 joins together and creates a more fitted shape to fit with the flask 60.

Figure 7:
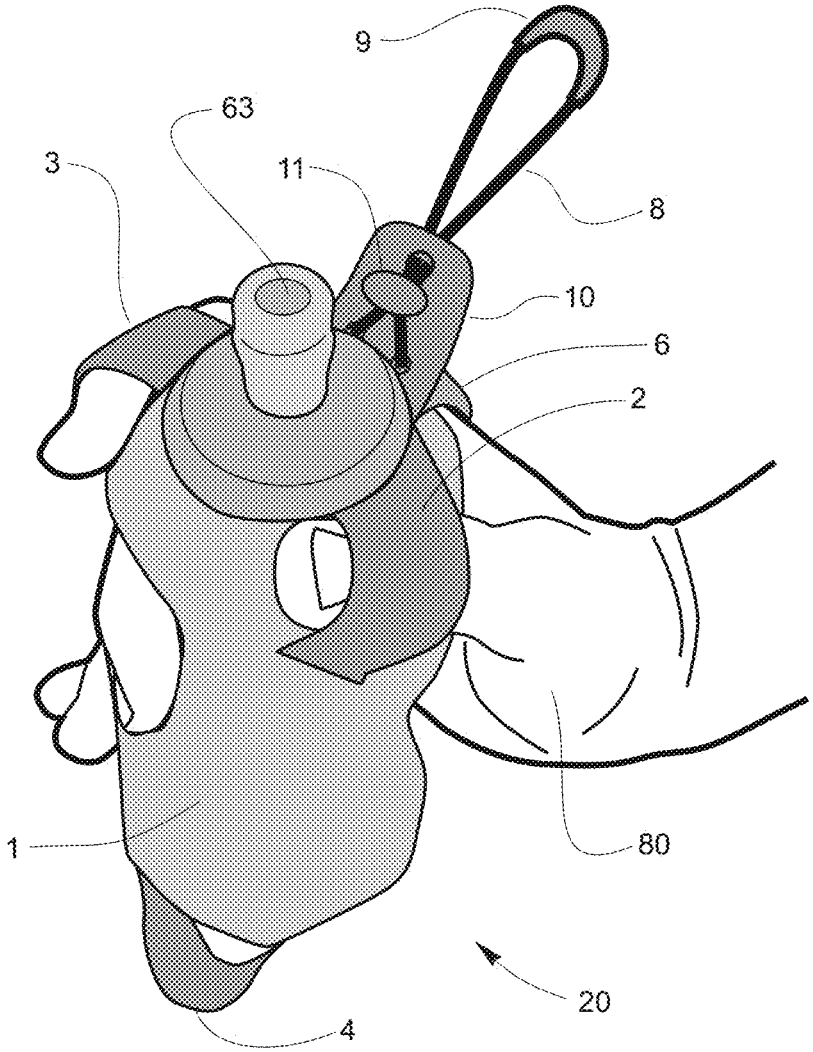
FIG. 7 is a front, top perspective view of a preferred compression sleeve attached to a bottle, further showing a user holding the bottle and sleeve in a hand.
Figure 8:
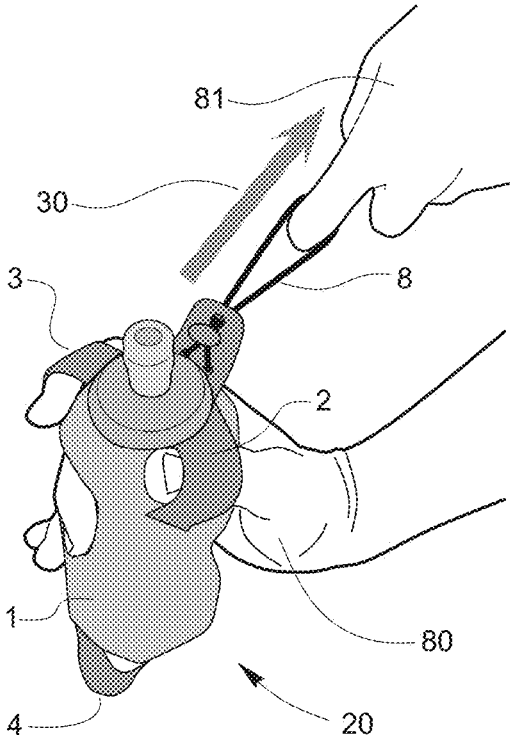
FIG. 8 is a front, top perspective view of a preferred compression sleeve attached to a bottle, further illustrating a user holding the bottle and sleeve in a hand, and pulling a cord to compress the sleeve.
Figure 9:
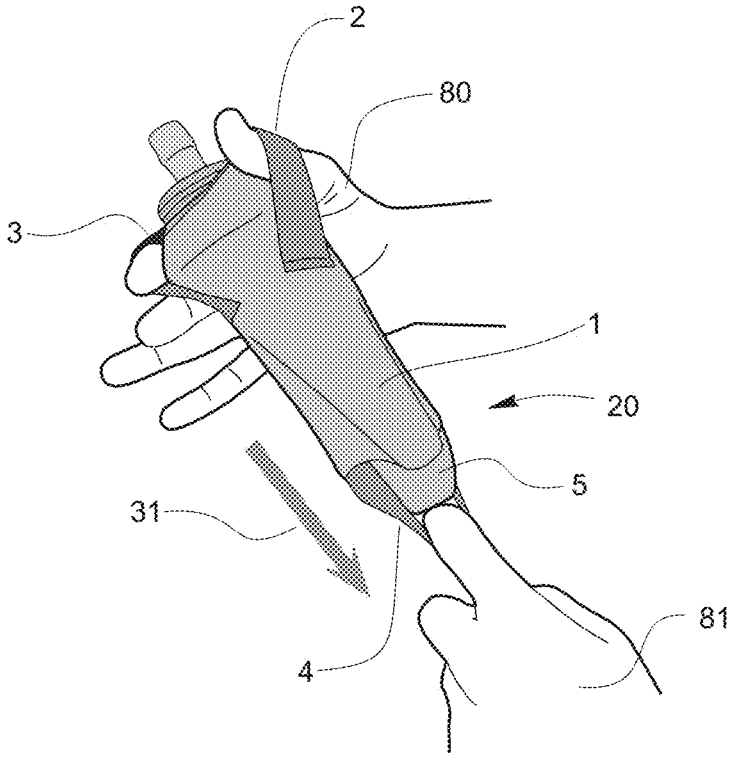
FIG. 9 is a front perspective view a preferred compression sleeve attached to a bottle, further illustrating a user holding the bottle and sleeve in a hand, and pulling a strap to transform the sleeve from a compressed mode to an uncompressed mode.

Several straps may be incorporated into the preferred compression sleeve, including finger/thumb straps 2, 3, a hand strap 6, and a loop strap 7. Each is preferably made from stretch webbing or other strapping material and cut to appropriate lengths to function for their intended hand strapping purpose as can be seen in FIGS. 7, 8 and 9.

Figure 2:
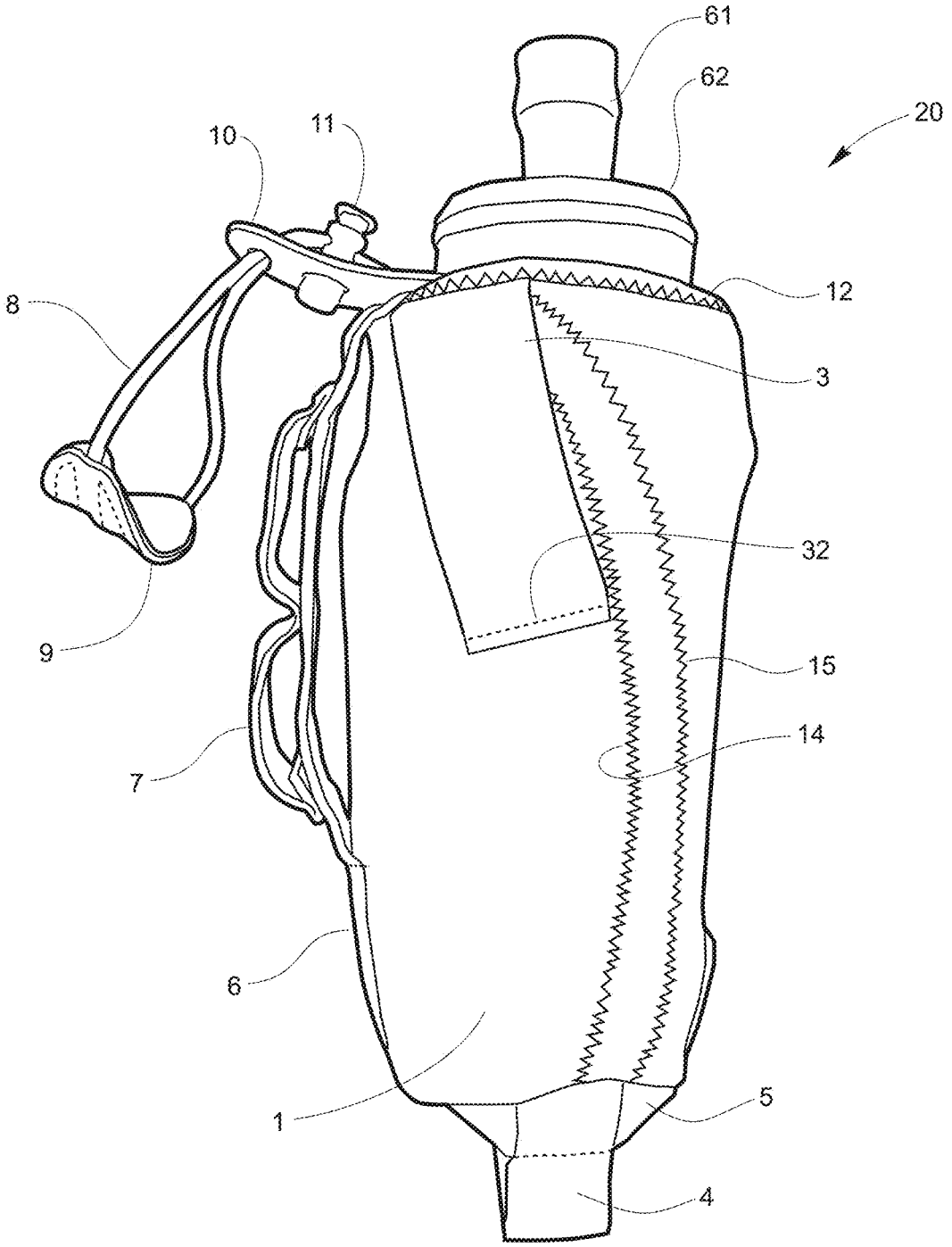
FIG. 2 is a left side view of a preferred compression sleeve attached to a bottle.
Figure 3:
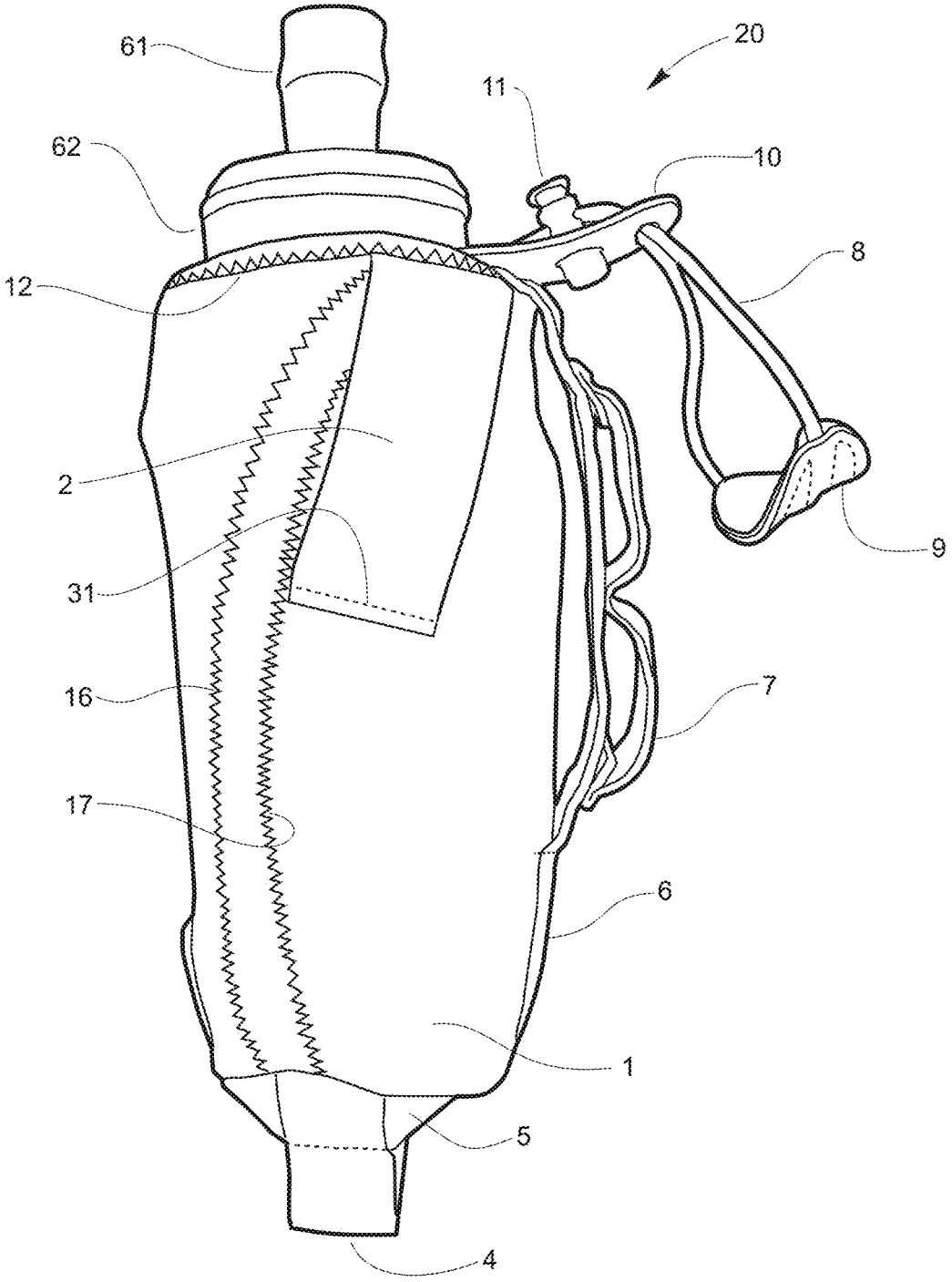
FIG. 3 is a right side view of a preferred compression sleeve attached to a bottle.
Figure 17:
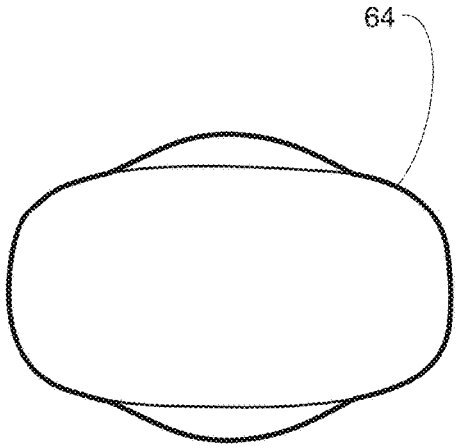
FIG. 17 is a bottom plan view of flask.

As shown for example in FIG. 3, a first finger/thumb loop 2 is attached to the main body of the sleeve, and is preferably sewn at its lower end to the sleeve body 1 at a stitch line 31 and at an upper end at an edge binding 12. The edge binding 12 is preferably located at the perimeter of the sleeve opening 51 (see FIG. 17). A second finger/thumb loop 3 is similarly attached at a lower stitch line 32 and at the upper edge binding 12, as best seen in FIG. 2.

Figure 5:
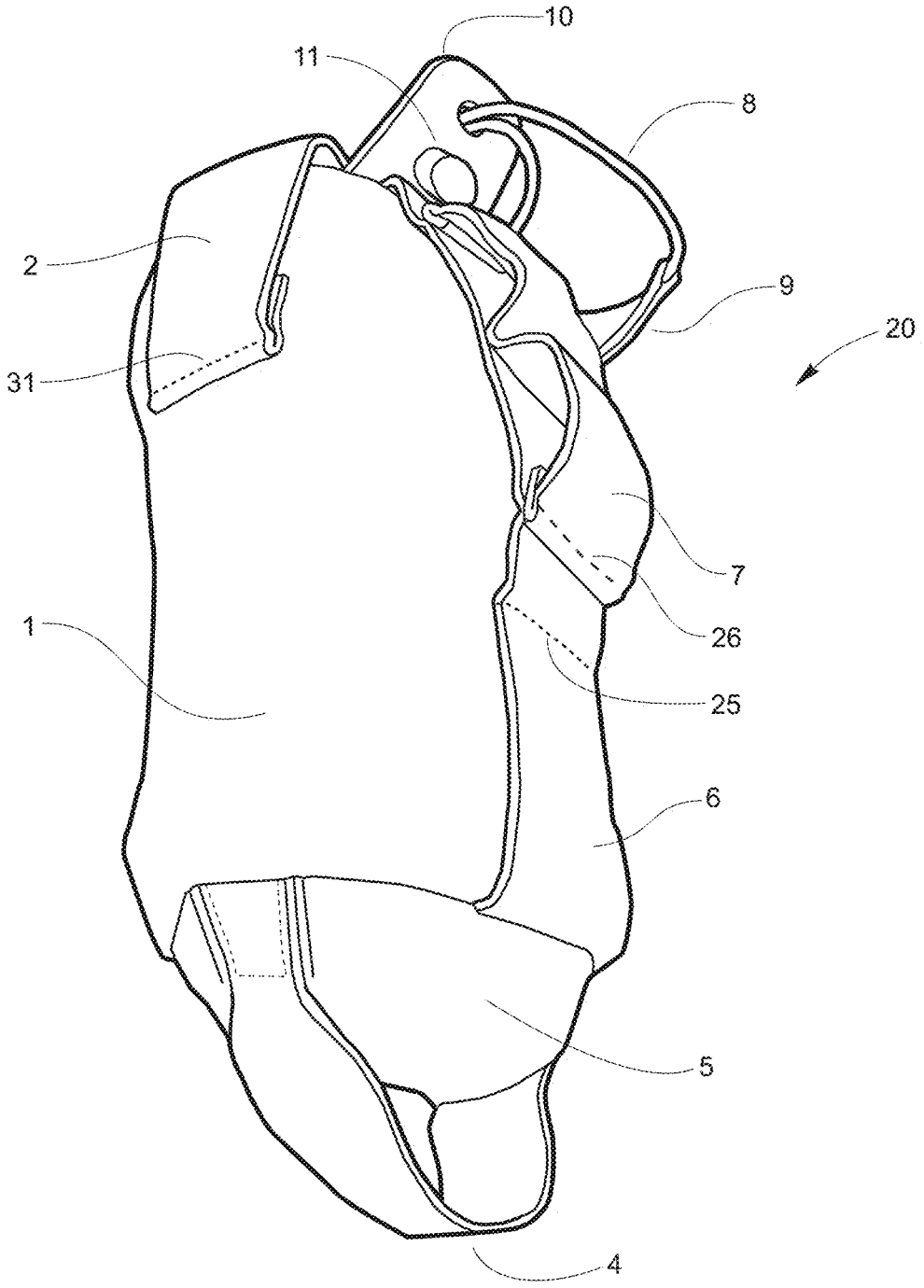
FIG. 5 is a rear, bottom perspective view of a preferred compression sleeve attached to a bottle.
Figure 6:
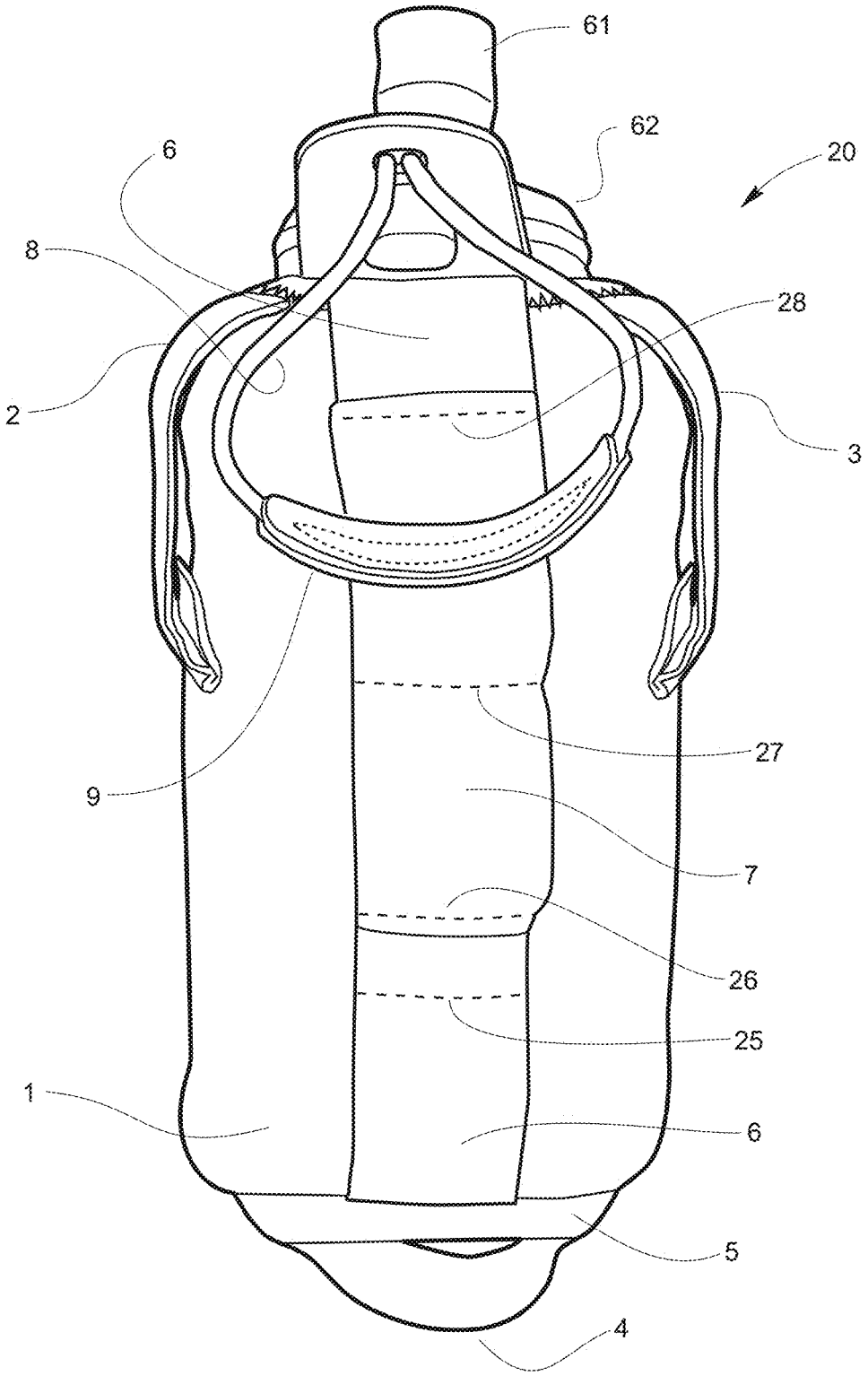
FIG. 6 is a rear view of a preferred compression sleeve attached to a bottle.

A hand strap 6 preferably extends from the bottom of the sleeve to the top of sleeve, as seen for example in FIGS. 5 and 6. Each of the first and second finger/thumb loops are attached to the top of the sleeve at a location adjacent the top of the hand strap 6, with the edge binding 12 preferably binds the perimeter of sleeve opening 51 together with the first and second finger/thumb loops 2, 3 and the hand strap 6.

A loop strap 7 is preferably placed and attached somewhat centrally on the hand strap 6 and stitched to that location with lower end stitch 26, and at its upper end with stitch 28 and preferably further stitched centrally between stitches 26 and 28 at central stitch 27, thereby forming first and second stretch loops 39 and 40, labeled in FIG. 1.

Figure 14:
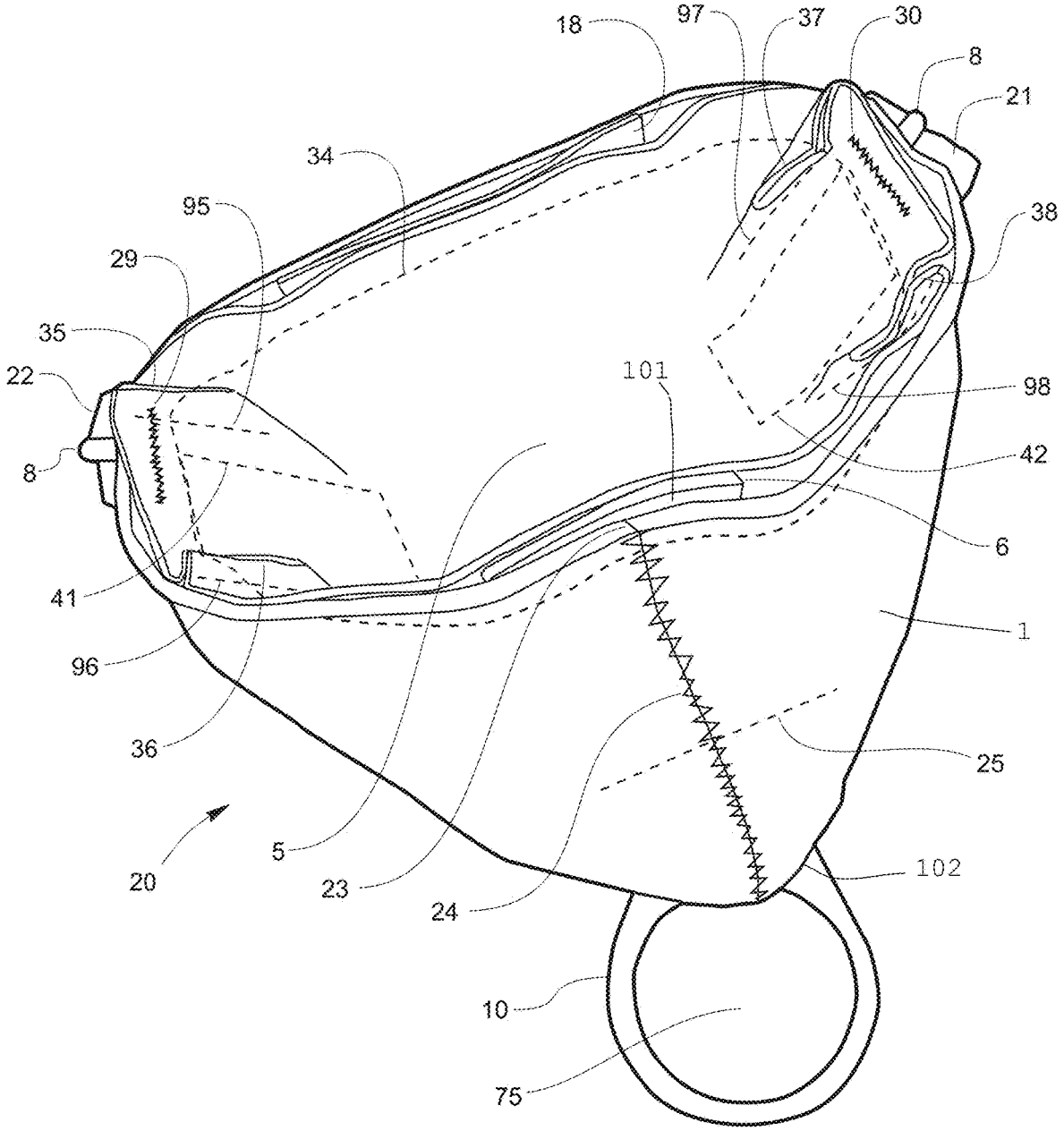
FIG. 14 is a bottom perspective view of a preferred compression sleeve, shown turned inside out.

The sleeve body 1 in its original flat form shown in FIG. 22 is preferably rolled in a tube and such that a first side edge 91 meets a second edge 92 and first and second side edges are joined together, preferably by stitching at a seam 23 with stitch 24 shown in FIG. 14, whereby a tube-shape is formed.

As can be seen in FIG. 14, in which the compression sleeve 20 is turned inside out, the joining stitch 24 preferably runs from the top 101 to the bottom 102 of sleeve body 1 whereby the sleeve body 1 is formed to contain a flask 60.

Preferably after the sleeve body 1 is sewn into a tube-like shape along stitch 24, and sleeve body 1 is turned right-side out, the hand strap 6 is affixed to sleeve body 1 at stitch 25, thereby allowing the hand strap 6 to overlay the joining stitch 24 such that the joining stitch 24 is preferably hidden behind the hand strap 6. Further, as mentioned, the top of sleeve body 1 is preferably edge-bound with edge binding 12, using stretchy edge binding fabric (spandex, stretch nylon, or the like) such that the top edge of sleeve body 1 is edge-bound along with the top strap ends of finger/thumb loops 2 and 3.

It should be noted that the placement of stitching 25 on the hand strap 6 is located such that the space between the stitch 25 and the top of the hand strap 6 where it is attached to the top of sleeve body 1 functions to securely hold the compression sleeve 20 on either a right or left hand as desired. Likewise, the bottom end of the hand strap 6 is preferably affixed into the seam between sleeve body 1 and base cup 5 and preferably sewn to that location by stitching 34. The hand strap 6 is preferably sewn to sleeve body 1 at stitch 25 toward the lower end of sleeve body 1 but at a distance which creates the appropriate space for a user's right or left hand.

Figure 18:
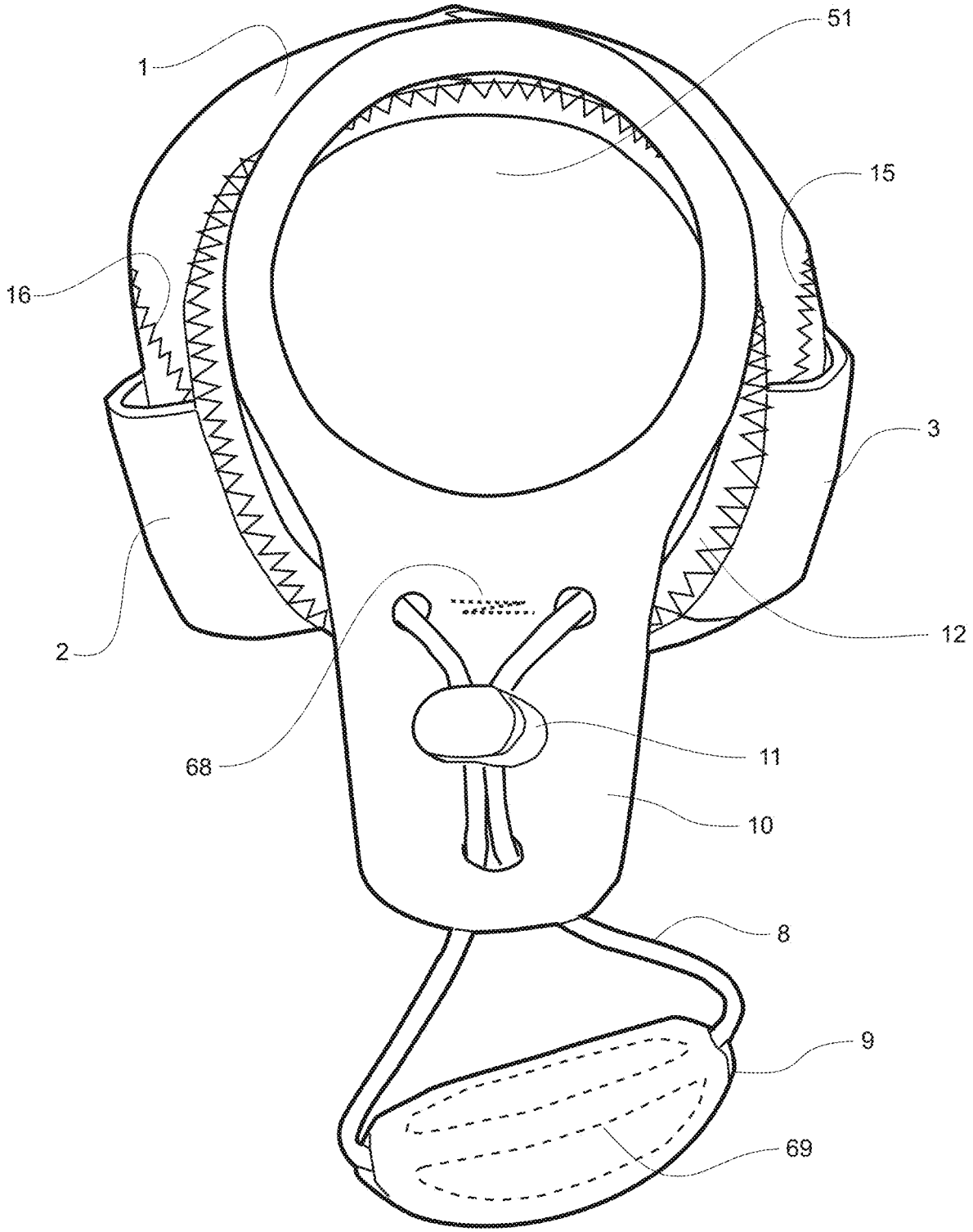
FIG. 18 is a top plan view of a preferred compression sleeve.
Figure 20:
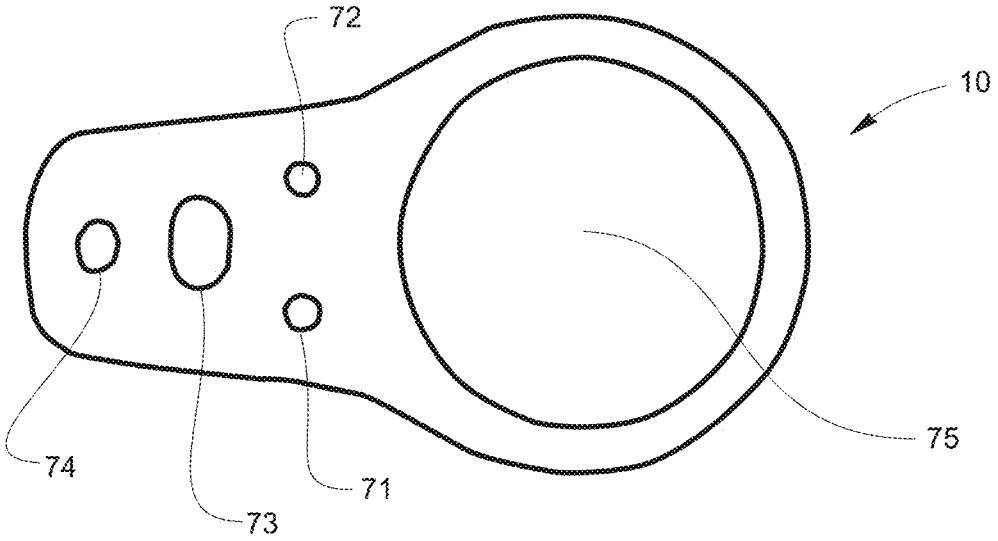
FIG. 20 is a plan view of collar junction for use with a preferred compression sleeve.

FIG. 20 shows a collar junction 10 which is preferably die cut, molded or otherwise formed from flexible plastic or similar materials. In one version, the collar junction 10 is formed from a sewable Polyethylene plastic and measures from 0.04 to 0.15 inches of thickness with a commonly desirable thickness of about 0.060 inches. As can be seen in FIG. 18, the collar junction 10 is preferably affixed to the sleeve body 1 by a fastener 68 which may be stitching, grommets, rivets, or other attachment techniques through the folded over strap end of the hand strap 6. The fastener 68 affixes the collar junction 10 firmly to the top of the sleeve body 1 by extending through the previously mentioned top fold-over end of the hand strap 6, as well as the edge-bound top edge of the sleeve body 1 which has been trapped between the hand strap 6 fold. In this fashion, the collar junction 10 is placed and sized to securely hold the neck 66 of the flask 60.

Figure 19:
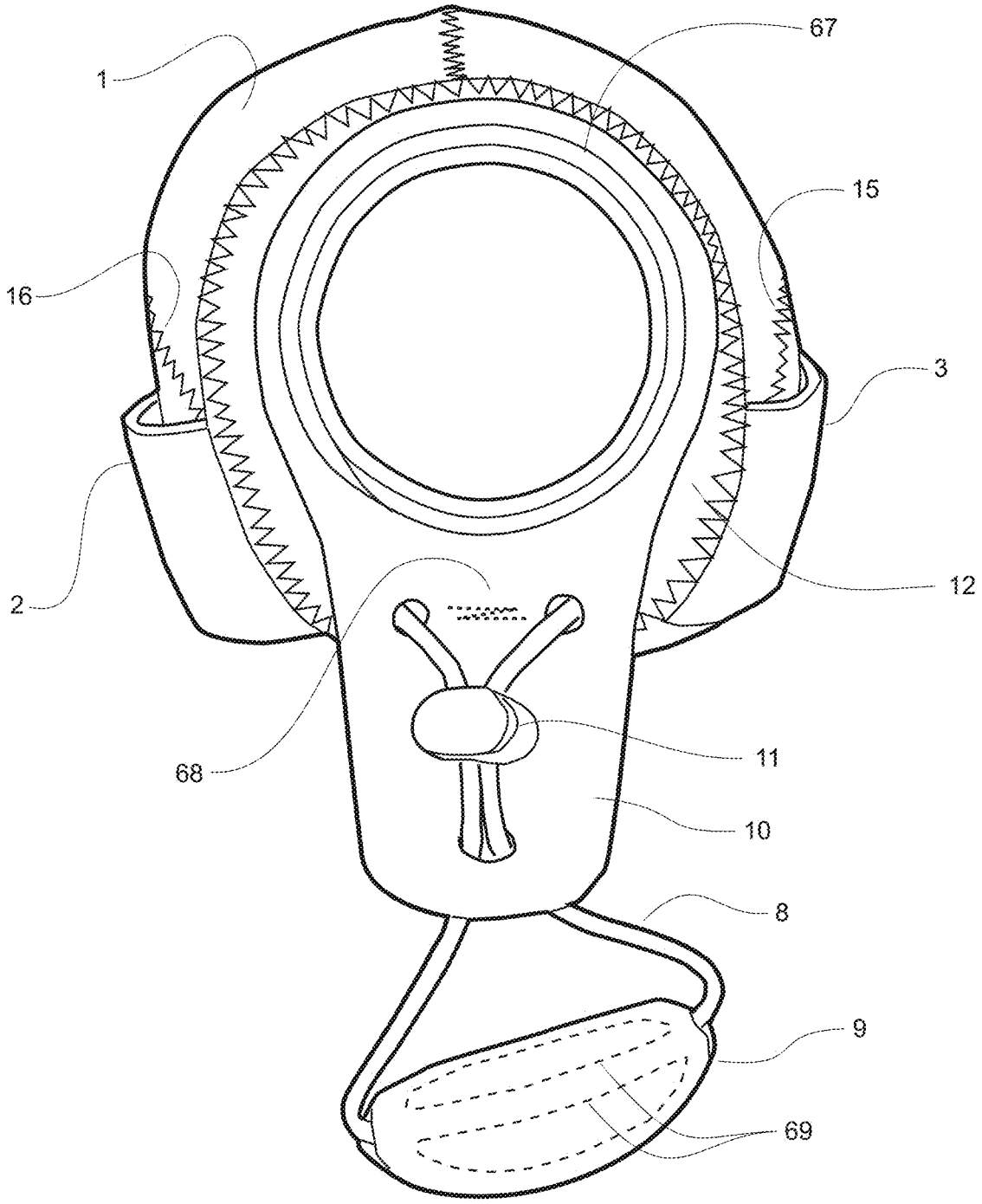
FIG. 19 is an alternate top plan view of a preferred compression sleeve.

As can be seen in FIGS. 19-20, the collar junction 10 includes a collar hole 75 which is sized to fit trapped under flask threads 67 wherein a user presses or threads the collar junction 10 in place on the flask neck 66 so that the collar junction 10 is held in place preferably in a space below the threads 67, allowing it to be removably retained by the cap 62. The collar junction 10 is preferably sewn in place to the top of the sleeve 1 as well as to the top of the hand strap 6 such that collar junction 10 is preferably placed substantially centered in between the top ends of the first and second finger/thumb loops 2, 3.

In FIG. 19 a pull grip 9 can be seen. The pull grip 9 is preferably made from two pieces of leather, Nubuck or non-woven material or the like, formed as two flat ovoid or football-shaped pieces of die-cut material which are placed together face-to face with a cord 8 sandwiched in between. The cord 8 is held captive between by stitching 69 such that cord 8 is held captive but preferably can slide with some friction as necessary between the sandwiched grip material, wherein when a user uses this pull grip 9 it can move to be centered between the ends of cord 8, and function as desired to allow a user to easily apply even force to the pull cord 8. A friction lock 11 is optionally provided, to trap the cord 8 and hold it in a fixed location with respect to the collar junction. Pulling on the cord 8 and thereby drawing it through cord tunnels 93 and 94 applies pressure to compress the flask 60. In other versions, a pull grip could be created with an injection molded or otherwise formed parts, or a short length of tube of flexible plastic, a swatch of fabric folded over and sewn in place, or with yet other materials to facilitate the actuation of pulling the cord 8 as well as functioning to stop the cord 8 from withdrawing back through hole 74.

The cord 8 is preferably cut from a length of cordage, preferably with little to no stretch, to allow a user to apply a strong compressive force to flask 60. The length of cord 8 is cut to size as the particular application requires, and can function well in the range of 18" to 26" long but the length is chosen depending on flask/sleeve size as well as how much slack is desired in a fully un-tensioned state as is shown in FIG. 1. A favorable length for cord 8 is about 24" long for a 16 fluid ounce soft flask bottle. Preferably the cord 8 is cut from a length of thin cordage with a diameter from 0.060" to 0.120", a desirable diameter being 0.075" such that a desirable friction hold is attained when cord 8 is installed in friction lock 11 wherein friction lock 11 functions to hold cord 8 in position. A user can therefore pull on the cord 8, applying a compressive force on flask 60 such that friction lock 11 holds cord 8 securely in place, but also releases cord 8 to slide when a user applies a moderate force, such that a user can adjust the amount of constriction of the sleeve and rely on friction lock 11 to hold a moderate compressive force applied to flask 60.

In some versions, a stretch cord could be used for the cord 8, although in most cases it is desirable to cut cord 8 from cordage similar to thin paracord-like cordage, nylon string or other durable cordage that is limited in stretch.

Figure 11:
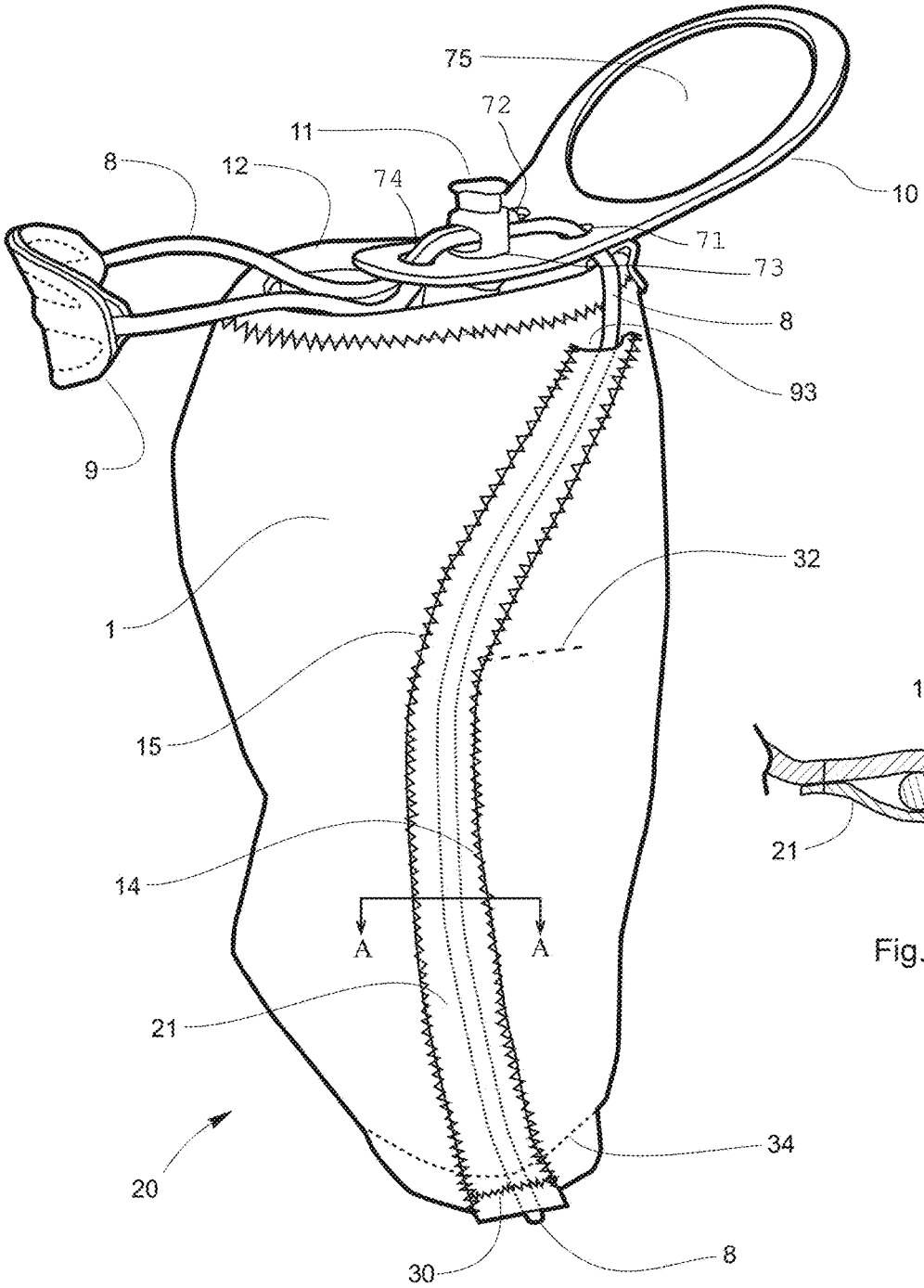
FIG. 11 is a perspective view of a preferred compression sleeve, shown turned inside out.
Figure 12:
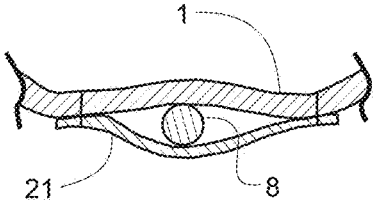
FIG. 12 is a partial sectional view, enlarged to show detail, through section A-A of FIG. 11.
Figure 13:
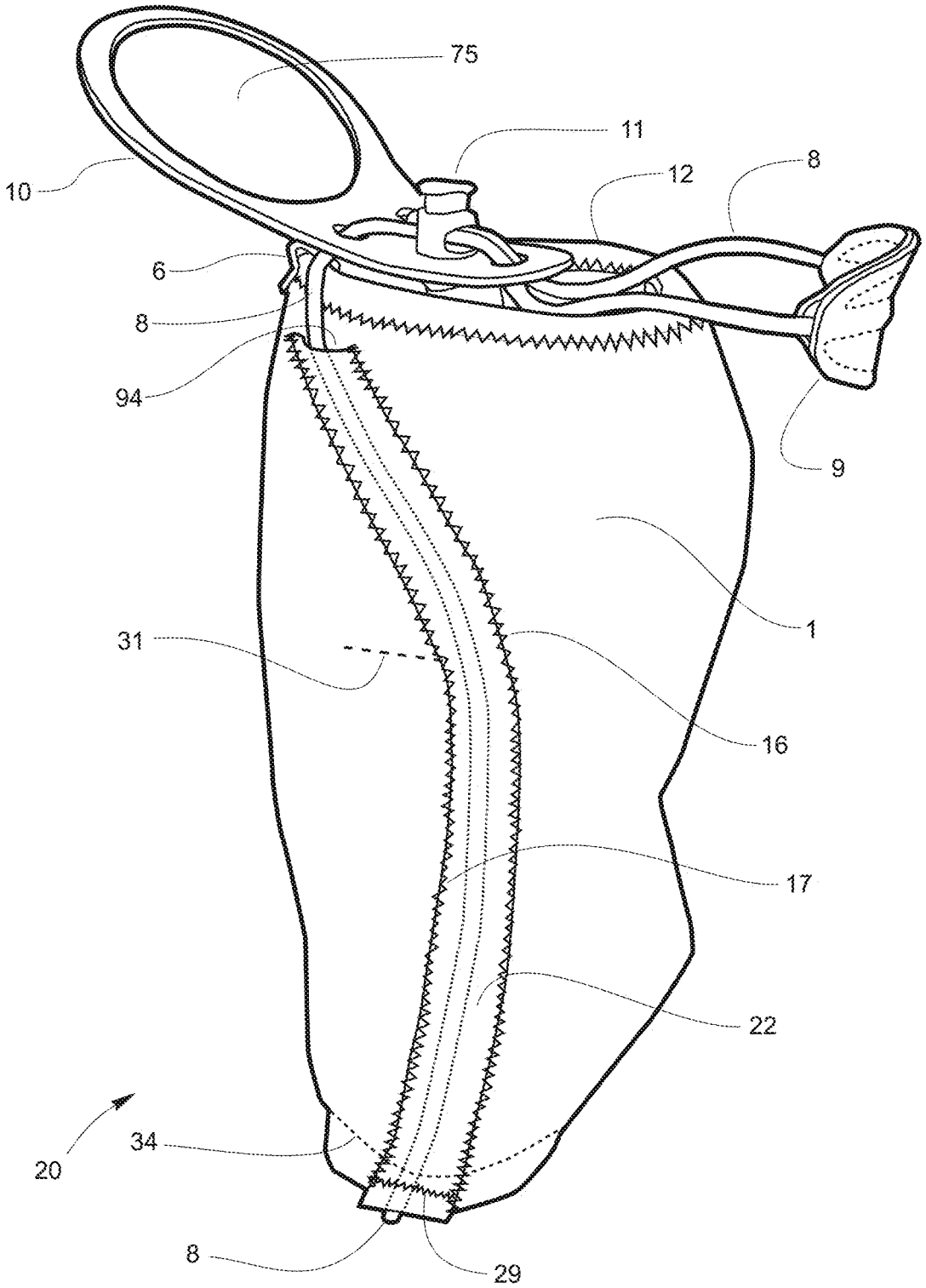
FIG. 13 is a perspective view of a preferred compression sleeve, shown turned inside out and showing an opposite side as compared with the view of FIG. 11.

FIG. 11, FIG. 13 and FIG. 14 show compression sleeve 20 turned inside out with flask 60 removed such that it can be seen how cord 8 is preferably installed.

As can be seen in FIG. 11 with grip pull 9 preferably installed halfway between the ends of cord 8, both ends of cord 8 are fed through hole 74 and through friction lock 11 (which is preferably held retained in hole 73), then cord 8 is separated and one side of cord 8 is fed through hole 72, the other being fed through hole 71 such that one side of cord 8 (the side adjacent to tunnel 93) is fed through tunnel 93 and the other side (that is adjacent tunnel 94; see FIG. 13) being fed through tunnel 94. Both ends of cord 8 are preferably fed through tunnels 93 and 94 such that cord 8 extends to the bottom of sleeve 1 wherein both ends are affixed in place by stitch 34. Cord 8 is further secured in place at the bottom of sleeve 1 one end by stitch 29 the other end is further affixed in place by stitch 30 (with stitch lines 29, 30 being positioned at the bottom of the sleeve 1).

Both FIG. 11 and FIG. 13 show cord 8 (in fine broken line) as it extends through cord tunnels 93 and 94. It should be noted that if non see-through material is used for tunnel cover strapping 21 and 22, cord 8 would generally be hidden from view as it transitions through tunnels 93 and 94 in FIG. 11 and FIG. 13, but cord 8 is nonetheless shown in fine broken line (representing a hidden feature) such that cord 8 can be illustrated as it travels through tunnels 93 and 94.

Figure 21:
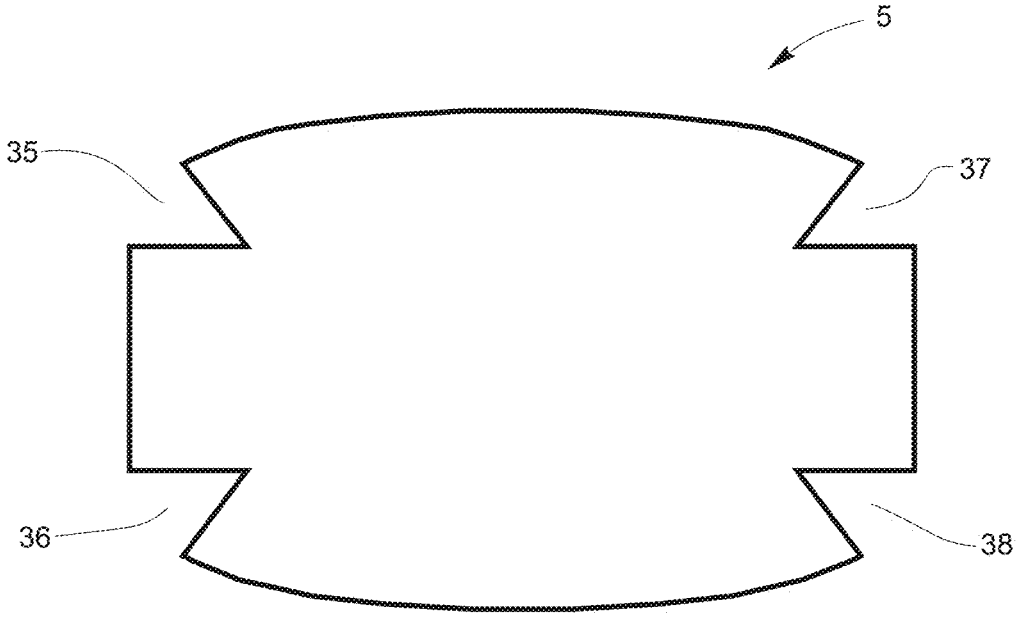
FIG. 21 is a plan view of a base cup for use with a preferred compression sleeve.

Base cup 5 is illustrated in flat form in FIG. 21, before it has been attached to the sleeve 20. The base cup is preferably die-cut from flat, thin, flexible, Hypalon or the like material, although leather, vinyl, plastic or other woven or non-woven materials could be used with varying degrees of success. A desirable thickness for base cup 5 flat stock material is 0.025" thick although it could be thinner or thicker with varying degrees of success.

Base cup 5, is preferably shaped as shown in FIG. 2, including "V" cut darts 35, 36, 37, and 38. The base cup darts are preferably folded together and sewn together by stitches 95, 96, 97 and 98 to form darts 35, 36, 37 and 38 as can be seen in FIG. 14. The base cup 5 with sewn together darts 35, 36, 37 and 38 creates a cupped structure whereby pull strap 4 is preferably sewn on the upwardly cupped sides of the base cup 5 by stitching 41 and 42, such that the pull strap 4 extends downwardly from the base cup as seen for example in FIG. 4. In this fashion, when the pull strap 4 is pulled by a user the pulling of the pull strap imparts a directed force on the ends of the cord 8 whereby cord 8 can be drawn through tunnels 93 and 94. It can be seen in FIG. 14 showing stitching 41 and 42 which preferably is stitched adjacent the ends of pull strap 4 through the preferably upwardly cupped sides of base cup 5 and further the ends of pull strap 4 preferably extend into the seam created by stitch 34 and preferably are sewn sandwiched between base cup 5 and sleeve body 1 wherein cord 8 and cord tunnel cover strapping 21 on one side and 22 on the other are preferably included in this sandwiching of layers that are preferably sewn together such that pull strap 4 is effective in imparting a desirable directed force on the ends of cord 8. As can be more fully understood in FIG. 14 with compression sleeve 20 turned inside out the preferable sandwiching of layers is: base cup 5, pull strap 4, sleeve body 1, cord 8, then cord tunnel strapping 21 on one side and on the other: base cup 5, pull strap 4, sleeve body 1, cord 8, then cord tunnel 22.

Figure 10:
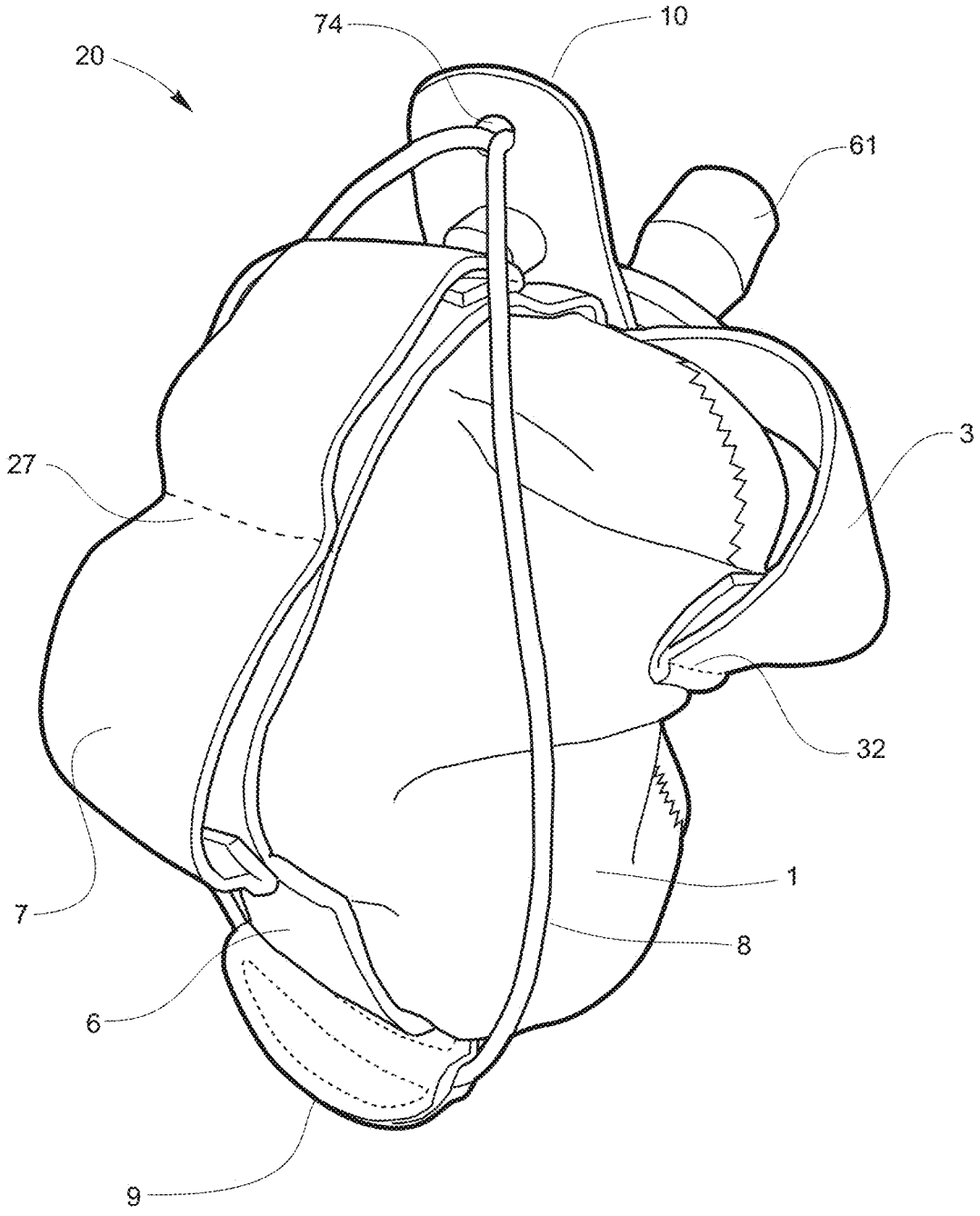
FIG. 10 is a rear perspective view of a preferred compression sleeve with a bottle or flask installed.

The pull strap 4 is preferably a length of nylon webbing cut to appropriate length such that a desirable loop is formed. A user can pull on the loop as shown in FIG. 9 to thereby impart a force on the ends of the cord 8, which draws the cord 8 through the friction lock 11, such that compression sleeve 20 transforms from the compact form as shown in FIG. 10 to fully extended form as shown in FIG. 1.

The pull strap 4 as mentioned is preferably is a length of webbing (nylon, polypropylene or the like) but it alternatively could be made with a length of leather, a strip of Hypalon or other woven or non-woven material.

A logo tag 18 is preferably affixed to the lower front edge of sleeve body 1 by stitching, heat application or the like and preferably extends into the seam between base cup 5 and sleeve body 1. Logo tag 18 is preferably molded from pliable rubber, but could be a woven tag or many other style logo tags as is desired.

Preferably after turning sleeve body 1 inside-out, and after the sleeve body has been assembled as described above with finger/thumb loops 2 and 3, hand strap 6 assembled with loop strap 7, pull cord 8 with pull grip 9, collar junction 10 and friction lock 11, the base cup 5 (which has preferably been pre-assembled with pull strap 4) is sewn at its perimeter to the bottom end of sleeve body 1 along stitch 34. FIG. 14 shows inside out compression sleeve 20 wherein stitch 34 can be seen which preferably affixes the bottom edge of sleeve body 1 to the perimeter of base cup 5 whereby the bottom end of hand strap 6, the two opposite ends of pull strap 4 and preferably the lower edge of logo tag 18 are sandwiched in the seam between the perimeter of base cup 5 and the lower end of sleeve body 1. And further, as mentioned preferably seam 34 also further strengthens the connection of the ends of cord 8 to base cup 5 as well as the ends of cord tunnel strapping 21 and 22.

It should be noted that friction lock 11, which preferably is a cord-lock style fastener, is preferably press-fit into hole 73 which is sized to accept friction lock 11 such that hole 73 preferably holds friction lock 11 in a securely retained manner. When a user pulls cord 8 as shown in FIG. 8 and FIG. 9, the friction lock 11 is held firmly in hole 73 of collar junction 10. Friction lock 11 preferably applies constant holding force to cord 8 such that it functions to hold cord 8 firmly yet allows cord 8 to slide when a user pulls sharply on pull strap 4 or pull grip 9 as can be seen in FIG. 8 and FIG. 9. Friction lock 11 is preferably a cord-lock, cord fastener or cord toggle style fastener which are used in industry to attach to drawstrings such that drawstrings can be fastened without using a knot. It should be noted that preferably a user does not need to compress the cord-lock or cord toggle to release pressure on cord 8, friction lock 11 and cord 8 are chosen and/or created such that an appropriate amount of holding force on cord 8 is applied to get the desired holding force yet allow cord 8 to slide when a sharp appropriate user force is applied to pull strap 4 or pull grip 9. Yet other means could be used in place of cord lock or fastener to create friction in order to serve as a cord retainer and thus hold cord 8 with varying degrees of success. For example instead of a cord lock a hole could be sized in a plastic component or directly in collar junction 10 such that friction is attained to hold cord 8. Also friction lock 11 could be integrally formed/created with collar junction 10 such that collar junction 10 has integrated friction locking means whereby cord 8 is held firmly to apply compressive force on flask 60 yet a user can apply a force to overcome said friction which allows a user to adjust cord 8 as desired. It may be desirable in some cases to replace the disclosed cord-lock style fastener with other friction or cord holding means such that the desired result of holding cord 8 as described it attained.

Figure 16:
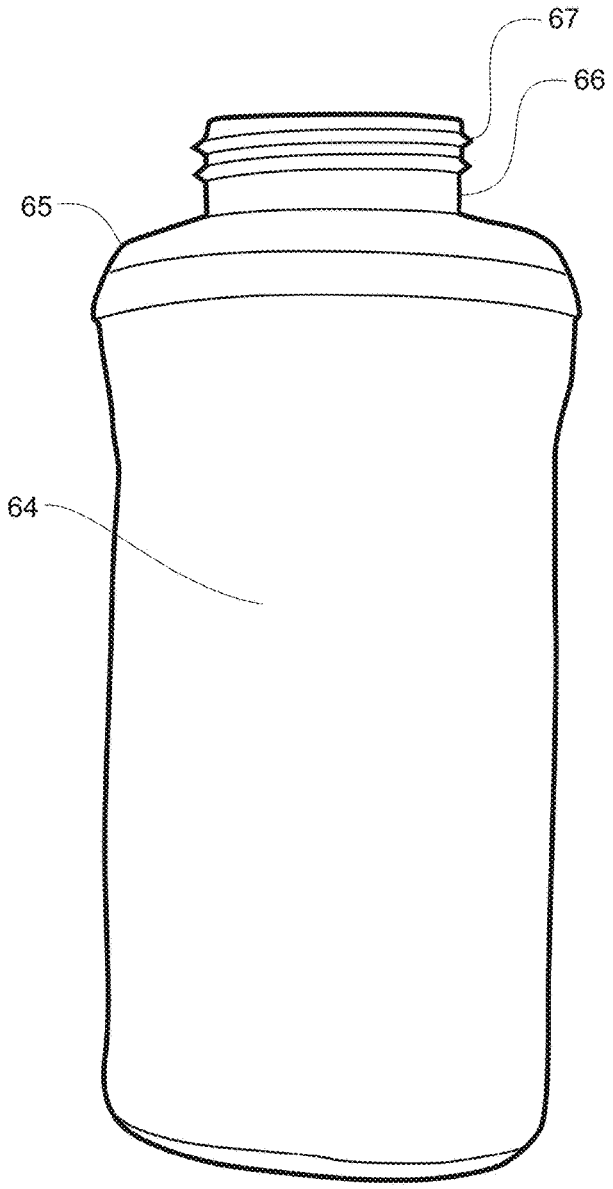
FIG. 16 is a front elevational view of the flask, with the cap removed.

After compression sleeve 20 has been preferably sewn together as described above, preferable compression sleeve 20 is turned right side out as can be seen in top view in FIG. 18 and flask 60 is installed such that the bottom of flask 60 is placed through the opening 51 of sleeve body 1, while collar junction is moved out of the way to allow flask 60 to be installed in compression sleeve 20. When flask 60 has been placed into compression sleeve 20, collar junction 10 is fitted onto neck 66, wherein collar hole 75 is sized to fit trapped under flask threads 67 wherein a user presses or threads or the like collar junction 10 in place on flask neck 66 wherein collar 10 is held in place preferably in a space below threads 67 to be removably retained and further retained by cap 62 which preferably mates to neck 66 and threads 67 to seal flask 60, see FIG. 16, FIG. 19, FIG. 20 and other figures.

Figure 15:
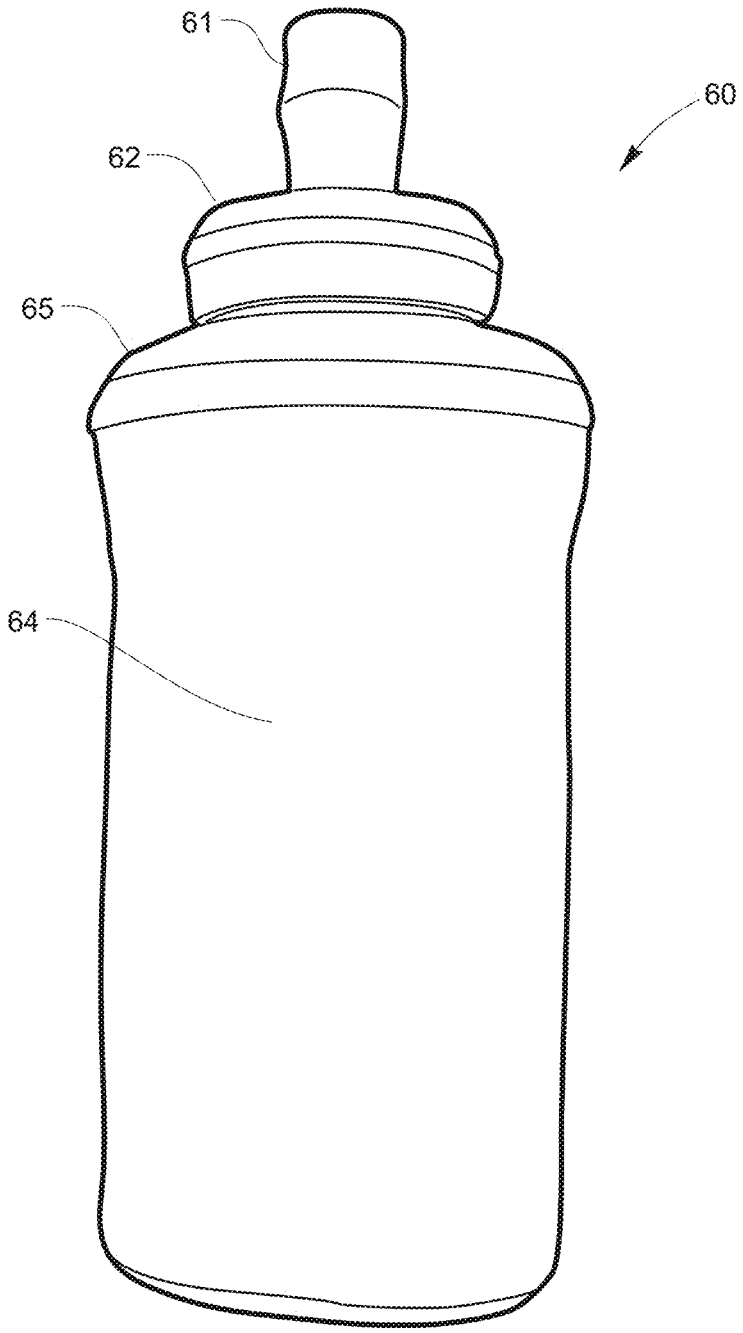
FIG. 15 is a front elevational view of a preferred bottle or flask, without a compression sleeve.

FIG. 15 shows flask 60, preferably a soft-flask style bottle, walls 64 preferably made from thin TPU (thermoplastic polyurethane) such that the walls are flexible similar to an intravenous (IV) bladder/bag or a bladder used in a bladder pack used for sports. Further flask 60 preferably has a locally stiffer top shoulder 65 preferably fused by ultrasonic welding, heat sealing or the like to sidewalls 64 and also fused by ultrasonic welding or the like or integrally formed with neck 66 with threads 67 whereby the somewhat flexible but stiffened shoulder 65 provides the user a stiffened shoulder for thumb and forefinger as can be seen in FIG. 7 to apply pressure to flask 60 such that when a user actuates compression sleeve as shown in FIG. 8 and FIG. 9 shoulder 65 facilitates actuation. There are a number manufacturing methods to create flask 60 such as the neck can be injection molded from plastics that are ultrasonically compatible with TPU, the sidewalls can be cut from flat stock and ultrasonically or heat welded together, the shoulder 65 can be injection molded or pressure formed or the like or integrally molded with the neck. Preferably sidewalls 64 are made of soft TPU, shoulder 65 being made of harder material but still with some flexibility and neck 66 with threads 67 being made of even harder material similar to the hardness of HDPE or polypropylene used in similar type water bottles.

Spout 61 is preferably molded from silicone or the like and is fashioned to be a preferable bite-style valve commonly used in the industry wherein when a user bites the valve spout 61 is deformed such that fluids can flow out the valve. Spout plug 63 allows valve 61 to seal plugging the opening of spout 61 wherein when spout 61 is deformed by a user fluids can flow out the deformed area around spout plug 63. Preferably spout 61, spout plug 63 and cap 62 are firmly assembled pressed together such that they can be disassembled to be cleaned but are retained very firmly but don't come off easily during normal use. Spout 61 could be a bite valve fashioned from silicone with a slit or "x"-shaped cut that deforms to allow fluids to flow, in this case spout 61 would preferably not need spout plug 63 and would be a simple bite valve commonly found on bladder packs used in biking. Cap 62 and spout plug 63 are preferably manufactured from polypropylene or HDPE or the like.

The disclosed preferable sleeve 1 is preferably constructed by sewing a somewhat flat die-cut panel of neoprene or the like together with adding other components such that the desired compression sleeve invention is attained. Although in many cases less preferably, the sleeve can be constructed by knitting, gluing, integrally forming and/or otherwise fastening parts together that have been manufactured from a variety of processes and techniques. Some other optional but less desirable (for most situations) fabrics for preferable sleeve include: leather, felt, waterproof/water resistant fabric and/or breathable/punched fabric or the like. The sleeve and other parts can be constructed in a number fabrics of different materials with varying degrees of success. The invention, with varying degrees of success could be constructed in a variety of different ways other than the preferable cut and sewn or otherwise fastened together manner. For example various parts of the invention could be combined, molded as one, woven, heat sealed together, ultrasonically bonded together or formed in other ways.

Although the description above contains many specificities, these should not be construed as limiting the scope of the invention but as merely providing illustrations of some of the presently preferred embodiment of this invention. The embodiment detailed in the figures and described herein can be combined in a variety of manners with varying degrees of success.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

We claim:

1. A fluid carrier, comprising:

a flexible bottle having an interior volume for holding the fluid, the flexible bottle being readily collapsible to conform the interior volume of the flexible bottle to a volume of the fluid held within the flexible bottle;

a compression sleeve surrounding the flexible bottle; and a pull-cord attached to the compression sleeve at a first location along the pull-cord and having a second location along the pull-cord extending from the compressing sleeve, the pull-cord being moveable from a first position in which the pull-cord is retracted to a second position in which the pull-cord is extended, wherein moving the pull-cord from the first position to the second position causes a contraction of the compression sleeve and a corresponding contraction of the flexible bottle.

2. The fluid carrier of claim 1, wherein the compression sleeve further comprises a top end and a bottom end, the first location of the pull-cord being attached to the bottom end of the compression sleeve and the second location of the pull-cord extending from the compression sleeve at a location relatively closer to the top end.

3. The fluid carrier of claim 2, wherein the flexible bottle further comprises a spout, the spout extending from the top end of the compression sleeve.

4. The fluid carrier of claim 2, wherein the pull-cord is further attached to the bottom end of the compression sleeve at a third location, the second location of the pull-cord being positioned between the first location and the third location.

5. The fluid carrier of claim 4, further comprising a friction lock, the friction lock engaging the pull-cord to retain the pull-cord in a plurality of positions between the first position and the second position.

6. The fluid carrier of claim 2, further comprising a bottom pull-strap, the bottom pull-strap being connected to the first location of the pull-cord, whereby pulling on the pull-strap in a first direction while holding the top end of the compression sleeve in a fixed position causes the pull-cord to move toward the first position.

7. The fluid carrier of claim 6, further comprising a first finger/thumb loop attached at the top end of the compression sleeve.

8. The fluid carrier of claim 7, further comprising a second finger/thumb loop attached at the top end of the compression sleeve.

9. The fluid carrier of claim 7, further comprising a loop strap forming a central loop located between the first finger/thumb loop and the second finger/thumb loop.

10. The fluid carrier of claim 2, wherein the pull-cord is further attached to the bottom end of the compression sleeve at a third location, the second location of the pull-cord being positioned between the first location and the third location, the compression sleeve further comprising a base cup, the base cup being positioned at the bottom end of the compression sleeve and having a first side attached to the first location of the pull-cord and a second side attached to the third location of the pull-cord.

11. The fluid carrier of claim 2, further comprising a collar junction attached to the top end of the compression sleeve, the collar junction being arranged such that a portion of the pull-cord and a portion of the flexible bottle extend through the collar junction.

12. The fluid carrier of claim 11, further comprising a friction lock attached to the collar junction, the friction lock engaging the pull-cord to retain the pull-cord in a plurality of positions between the first position and the second position.

13. The fluid carrier of claim 2, wherein the pull-cord is trained within a first cord tunnel extending along the compression sleeve from a top end of the compression sleeve to a bottom end of the compression sleeve.

14. The fluid carrier of claim 2, wherein:

the pull-cord is further attached to the bottom end of the compression sleeve at a third location, the second location of the pull-cord being positioned between the first location and the third location;

a first portion of the pull-cord between the first location and the second location is trained within a first cord tunnel extending along the compression sleeve from a top end of the compression sleeve to a bottom end of the compression sleeve; and a second portion of the pull-cord between the third location and the second location is trained within a second cord tunnel extending along the compression sleeve from a top end of the compression sleeve to a bottom end of the compression sleeve.

15. The fluid carrier of claim 1, wherein the compression sleeve comprises an elastomeric layer having a first end and a second end joined together to define a seam, and a central stitch securing the first end to the second end along the seam.

16. A fluid carrier, comprising:

a compression sleeve surrounding a flexible bottle, the flexible bottle having an interior volume for holding the fluid, the flexible bottle further being deformable upon application of a force by the compression sleeve to reduce the interior volume of the flexible bottle;

a pull-cord attached to the compression sleeve at a first location along the pull-cord and at a third location along the pull-cord, the pull-cord having a second location along the pull-cord between the first location and the third location, the second location extending from the compressing sleeve, a first cord tunnel defined on the compression sleeve and a second cord tunnel defined on the compression sleeve, the pull-cord between the first location and the second location being trained within the first cord tunnel, and the pull-cord between the second location and the third location being trained within the second cord tunnel;

the pull-cord being moveable by pulling on the second location to move the pull-cord from a first position in which the pull-cord is retracted to a second position in which the pull-cord is extended, wherein moving the pull-cord from the first position to the second position causes a contraction of the compression sleeve.

17. The fluid carrier of claim 16, wherein the compression sleeve further comprises a top end and a bottom end, the first location of the pull-cord being attached to the bottom end of the compression sleeve and the third location being attached to the bottom end of the compression sleeve.

18. The fluid carrier of claim 17, further comprising a collar junction attached to the top end of the compression sleeve, the collar junction being arranged such that a portion of the pull-cord and a portion of the flexible bottle extend through the collar junction.

19. The fluid carrier of claim 18, wherein the flexible bottle further comprises a spout, the spout extending through the collar junction.

20. The fluid carrier of claim 18, further comprising a friction lock attached to the collar junction, the friction lock engaging the pull-cord to retain the pull-cord in a plurality of positions between the first position and the second position.

21. The fluid carrier of claim 17, further comprising a bottom pull-strap, the bottom pull-strap being connected to the first location of the pull-cord and to the third location of the pull-cord, whereby pulling on the pull-strap in a first direction while holding the top end of the compression sleeve in a fixed position causes the pull-cord to move toward the first position.

22. The fluid carrier of claim 21, further comprising a first finger/thumb loop attached at the top end of the compression sleeve.

23. The fluid carrier of claim 22, further comprising a loop strap forming a central loop located between the first finger/thumb loop and the second finger/thumb loop.

24. The fluid carrier of claim 21, further comprising a base cup, the base cup being positioned at the bottom end of the compression sleeve and having a first side attached to the first location of the pull-cord and a second side attached to the third location of the pull-cord.

* * * * *